US006584790B1

(12) United States Patent
Lopes

(10) Patent No.: US 6,584,790 B1
(45) Date of Patent: Jul. 1, 2003

(54) AIR FLOW CONTROLLING DEVICE FOR REFRIGERATORS AND FREEZERS

(75) Inventor: Luis Antonio Diemer Lopes, Joinville-SC (BR)

(73) Assignee: Multibras S.A. Eletrodomesticos, Sao Paula (BR)

( * ) Notice: Subject to any disclaimer, the term of this patent is extended or adjusted under 35 U.S.C. 154(b) by 0 days.

(21) Appl. No.: 10/031,093

(22) PCT Filed: Jul. 12, 2000

(86) PCT No.: PCT/BR00/00076

§ 371 (c)(1),
(2), (4) Date: Apr. 9, 2002

(87) PCT Pub. No.: WO01/04555

PCT Pub. Date: Jan. 18, 2001

(30) Foreign Application Priority Data

Jul. 13, 1999 (BR) ..... 9903354

(51) Int. Cl.[7] ..... F25D 17/04

(52) U.S. Cl. ..... 62/187; 62/186; 62/408; 165/294

(58) Field of Search ..... 62/187, 186, 404, 62/408, 89, 97, 337; 137/625.45, 625.46; 165/294

(56) References Cited

U.S. PATENT DOCUMENTS

| | | | | |
|---|---|---|---|---|
| 4,006,601 A | | 2/1977 | Ballarin et al. | 62/80 |
| 5,642,628 A | * | 7/1997 | Whipple et al. | 62/186 |
| 5,711,159 A | | 1/1998 | Whipple, III | 62/82 |
| 5,816,061 A | | 10/1998 | Lee et al. | 62/187 |
| 6,032,469 A | | 3/2000 | Kim et al. | 62/89 |

FOREIGN PATENT DOCUMENTS

| | | | |
|---|---|---|---|
| JP | 02021076 | 1/1990 | F16K/11/085 |
| WO | WO 01/04555 A1 | 3/1996 | F25D/17/04 |

* cited by examiner

*Primary Examiner*—Chen Wen Jiang
(74) *Attorney, Agent, or Firm*—Darby & Darby

(57) ABSTRACT

An air flow controlling device for refrigerators and freezers, comprising an evaporator (3) in selective fluid communication with at least two air flow heating environments (1, 2, 4), said device comprising an inlet nozzle (12) in fluid communication with a respective airflow heating environment (1, 2, 4), and an outlet nozzle (13) in fluid communication with the evaporator (3), and a respective obturator (20), which is operatively associated with the inlet and outlet nozzles (12, 13) and displaceable between opening and closing positions, respectively permitting and blocking the fluid communication between said inlet and outlet nozzles (12, 13).

14 Claims, 5 Drawing Sheets

AIR FLOW CONTROLLING DEVICE FOR REFRIGERATORS AND FREEZERS

FIELD OF THE INVENTION

The present invention refers to an air flow controlling device to be used in refrigerators and freezers, in which the evaporator may be provided isolated from the refrigeration compartment, and particularly in those appliances in which the refrigeration of any refrigerated compartment is obtained by forced air circulation and the defrost is automatically made by natural convection.

BACKGROUND OF THE INVENTION

In the refrigeration appliances, particularly those of the "no frost" type, in which, the freezing and refrigerating compartments are refrigerated by forced air circulation, the temperature in the compartments is controlled by a thermostat provided, for example, adjacent to an evaporator and which determines the switching on and off of the compressor, upon detecting the respective maximum and minimum temperatures of a temperature interval previously determined as the ideal operational temperature interval of at least one of the freezing and refrigerating compartments.

The refrigeration of the freezing and refrigerating compartments of these appliances is obtained by forced air circulation through the evaporator towards said compartments, by actuation of a fan.

In a known solution, in at least one of the ducts which connects the evaporator to a respective freezing or refrigerating compartment, there is provided a thermostatic valve, which selectively interrupts and permits the fluid communication between the respective compartment and the outlet of the evaporator.

In the known constructions of a thermostatic valve, said valve has a movable vane, which opens or closes the air passage, in order to regulate the temperature of the respective freezing or refrigerating compartment detected by a sensing bulb of said thermostatic valve provided in this compartment. In the closing operation of the vane of the thermostatic valve, said vane interrupts the flow of cold air from the evaporator to the respective compartment.

In this construction, when it is necessary to refrigerate only one compartment, the thermostatic valve thereof is commanded to present an operational condition, so that the respective compartment receives cold air from the evaporator.

Besides using one or more thermostatic valves of a relatively complex construction, this solution allows, at the inlet region of the evaporator, i.e., at the fan region, the mixture of the air flows from the compartments of the refrigeration appliance, which usually have very distinct temperatures. Said mixture of air masses with a high temperature differential results in energetic losses for the refrigeration system.

An alternative to avoid this mixture of air masses at different temperatures is to duplicate the circuits and the active equipments (fans, evaporators). When the refrigeration appliance has more than one forced air circuit, for example, such as described in the copending patent application, of the same applicant, filed on Jun. 21, 1999, with the title "An Automatic Defrost System for a Refrigerating Device", it is also required to provide, in each circuit, a respective thermostatic valve, said valves being controlled by a control unit, in order to guarantee a desired operational synchronism between said forced air circuits.

However, these solutions increase the amount of components in the refrigeration circuit, affecting the maintenance, the arrangement of the inner space in the cabinet of the refrigeration appliance, besides increasing the final cost of the product.

DISCLOSURE OF THE INVENTION

It is a general objective of the present invention to provide an air flow controlling device for refrigerators and freezers, with a simple construction and practical installation, which allows to selectively interrupt and establish the fluid communication between the evaporator and each refrigeration compartment of the refrigerator or freezer, either in a refrigeration or in a defrost condition.

This and other objectives are achieved by an air flow controlling device for refrigerators and freezers, comprising at least two air flow heating environments and an evaporator positioned externally to said air flow heating environments and in selective fluid communication therewith, said device comprising, for each air flow heating environment, an inlet nozzle in fluid communication with the respective air flow heating environment, and an outlet nozzle in fluid communication with the evaporator and a respective obturator, which is operatively associated with the inlet and outlet nozzles and affixed to a respective shaft portion rotating between opening and closing positions, respectively permitting and blocking the fluid communication between said inlet and outlet nozzles, said shaft portions of the obturators forming a single common shaft, which is rotatively driven by a motor unit commanded by a control unit.

BRIEF DESCRIPTION OF THE DRAWINGS

The invention will be described below, with reference to the attached drawings, in which.

BEST MODE OF CARRYING OUT THE PRESENT INVENTION

Figure 1:
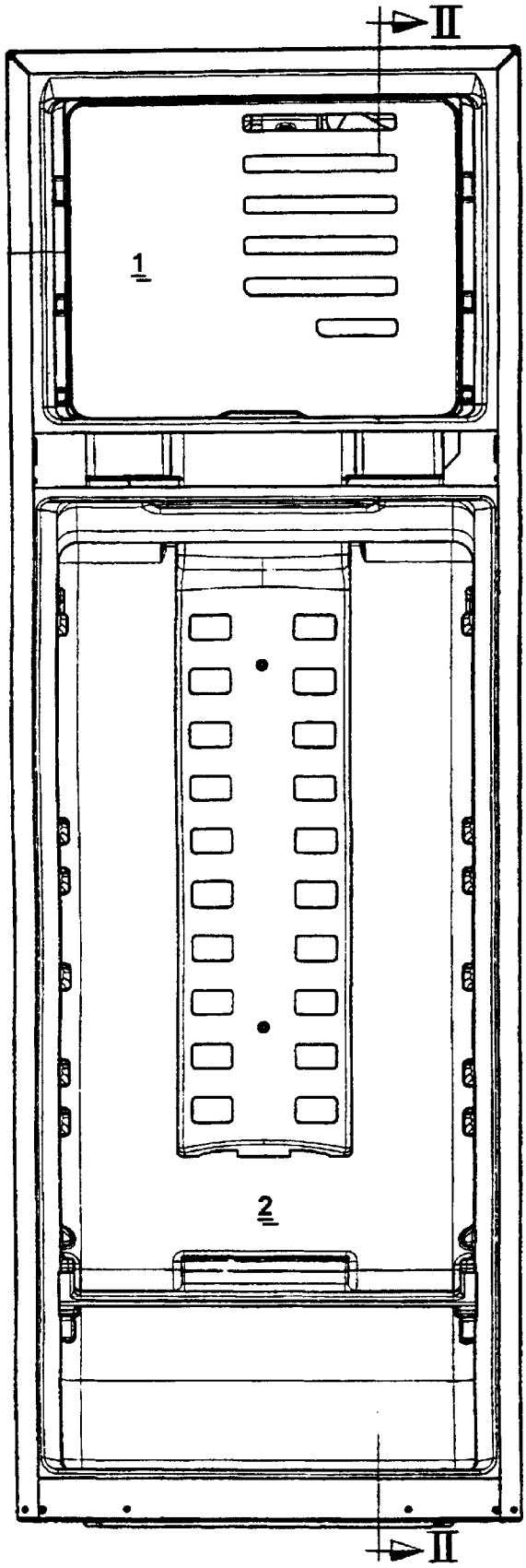
FIG. 1 illustrates, schematically, a front view of a refrigerator cabinet, without the door and showing the control device of the present invention.
Figure 2:
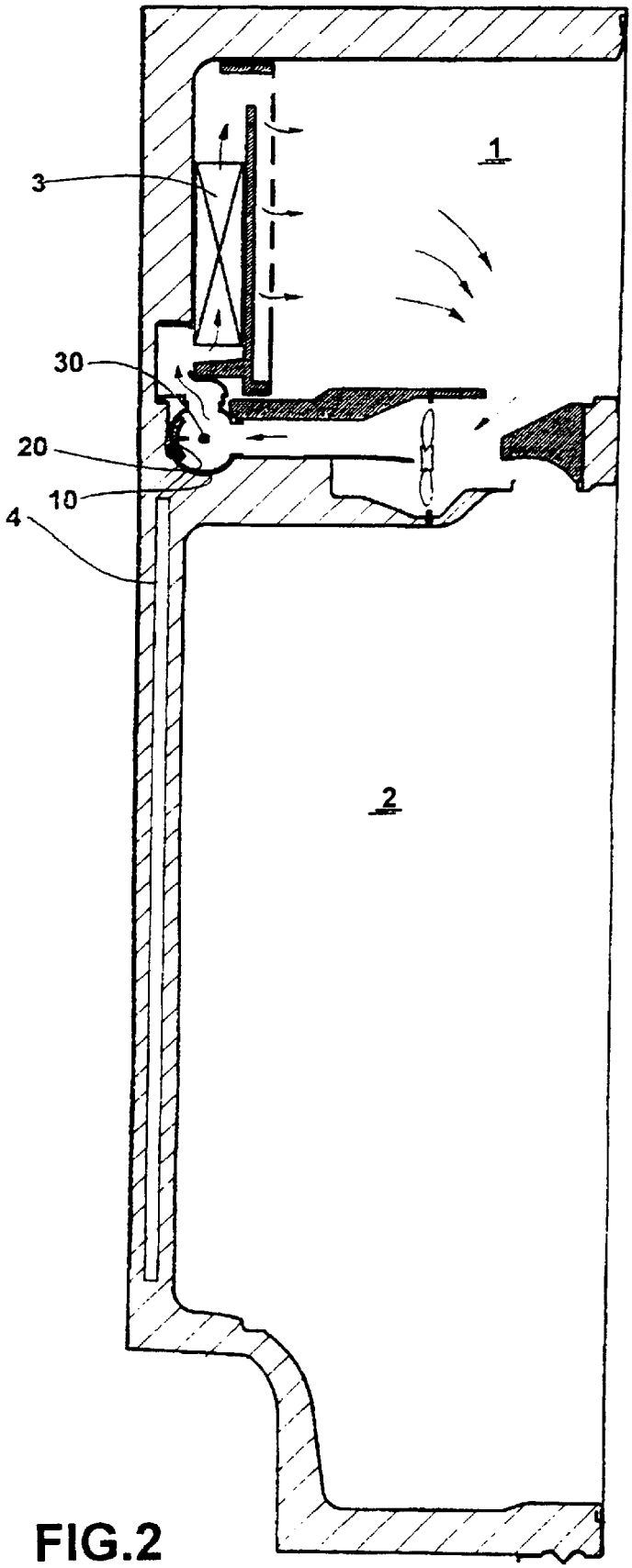
FIG. 2 illustrates, schematically and in a lateral longitudinal sectional view, the cabinet shown in FIG. 1 with the control device of the present invention in an operational condition allowing the fluid communication between the evaporator and the freezing and refrigerating compartments.
Figure 3:
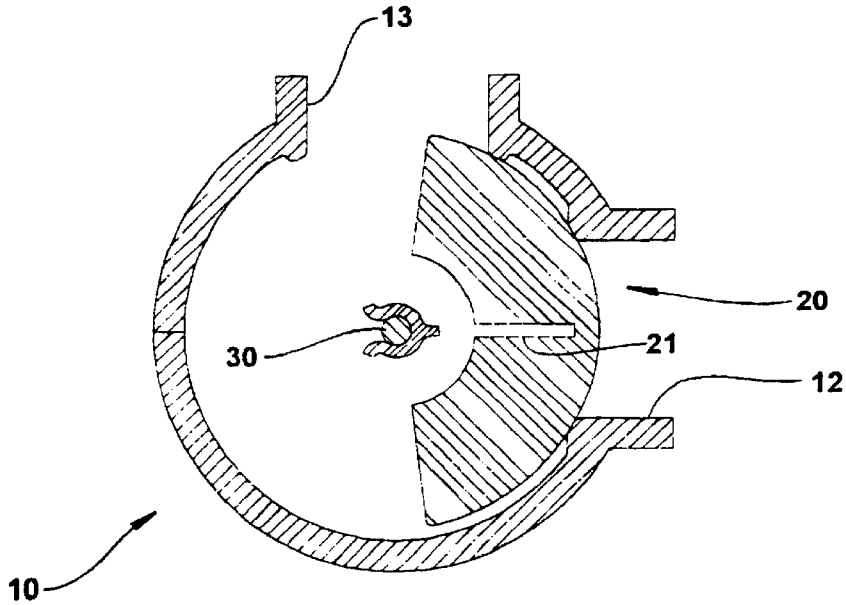
FIG. 3 illustrates, schematically and in a cross-sectional view, a construction for the device of the present invention.
Figure 4:
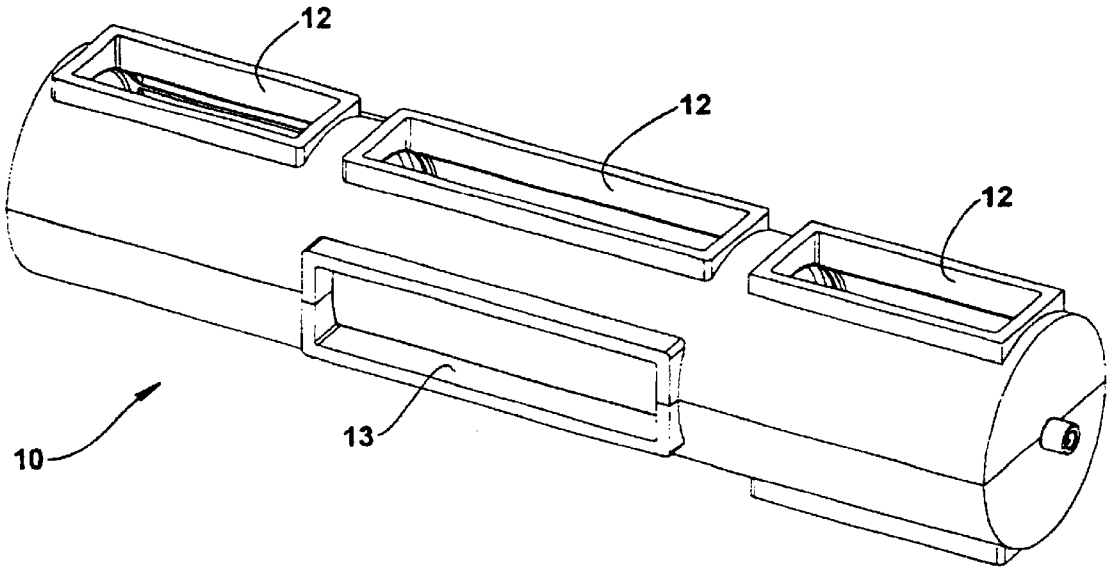
FIG. 4 illustrates, schematically and in a perspective view, another constructive form for the device of the present invention.

The air flow controlling device for refrigerators and freezers of the present invention will be described in relation to a refrigeration appliance, such as that disclosed in the copending patent application, of the same applicant and entitled "An Automatic Defrost System for a Refrigerating Device", which has inside a cabinet at least two air flow heating environments, in which the air flow loses frigorie and which are, for example, defined by at least one of the freezing and refrigerating compartments 1, 2 in selective fluid communication with an evaporator 3 (for example provided in an environment external and adjacent to a rear wall of the freezing compartment 1), whose temperature is maintained within a temperature interval previously defined as the ideal operational temperature, as a function of the operation of a non-illustrated compressor.

In a refrigerator construction, such as that disclosed in the copending patent application cited above and illustrated in the appended figures, one of the at least two air flow heating environments may be further defined by an air heating chamber 4 of a defrost circuit and provided adjacent to a condenser of the refrigerator.

According to the present invention, the air flow controlling device is provided in a passage of an air return duct of the air flow heating environments, in series with said air return duct.

The air flow controlling device of the present invention comprises, in the illustrated embodiment, a tubular case 10 formed by the assembly of a plurality of hollow bodies 11, each corresponding to a respective air flow heating environment and defining, internally, a chamber and provided with an inlet nozzle 12 in fluid communication with the respective air flow heating environment, and an outlet nozzle 13 in fluid communication with the evaporator 3.

The controlling device of the present invention further comprises, inside each hollow body 11, an obturator 20, for example in an elastomeric material, such as rubber, mounted to a respective shaft portion of a shaft 30, which is journalled in the tubular case 10 so as to be able to rotate between opening and closing positions, respectively allowing and blocking the fluid communication between the inlet and outlet nozzles 12, 13 of the respective hollow body 11.

Figure 5:
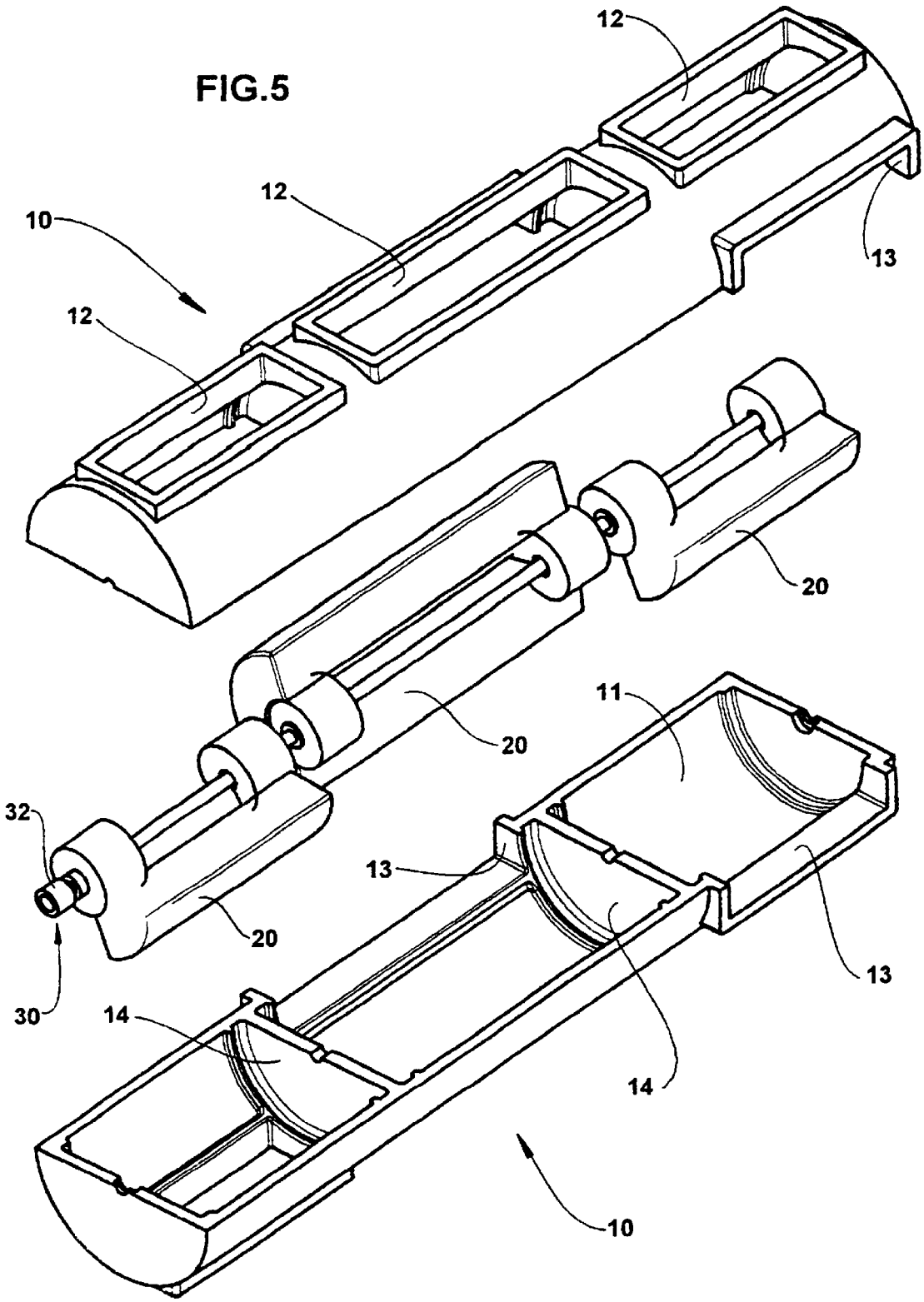
FIG. 5 illustrates, schematically and in an exploded perspective view, the device illustrated in FIG. 4.

In the illustrated construction (FIGS. 5–7), the obturators 20 of all hollow bodies 11 are mounted longitudinally aligned to each other, on the shaft 30, which is common to all obturators 20 and driven by a non-illustrated motor unit commanded by a control unit, not illustrated either.

Figure 8:
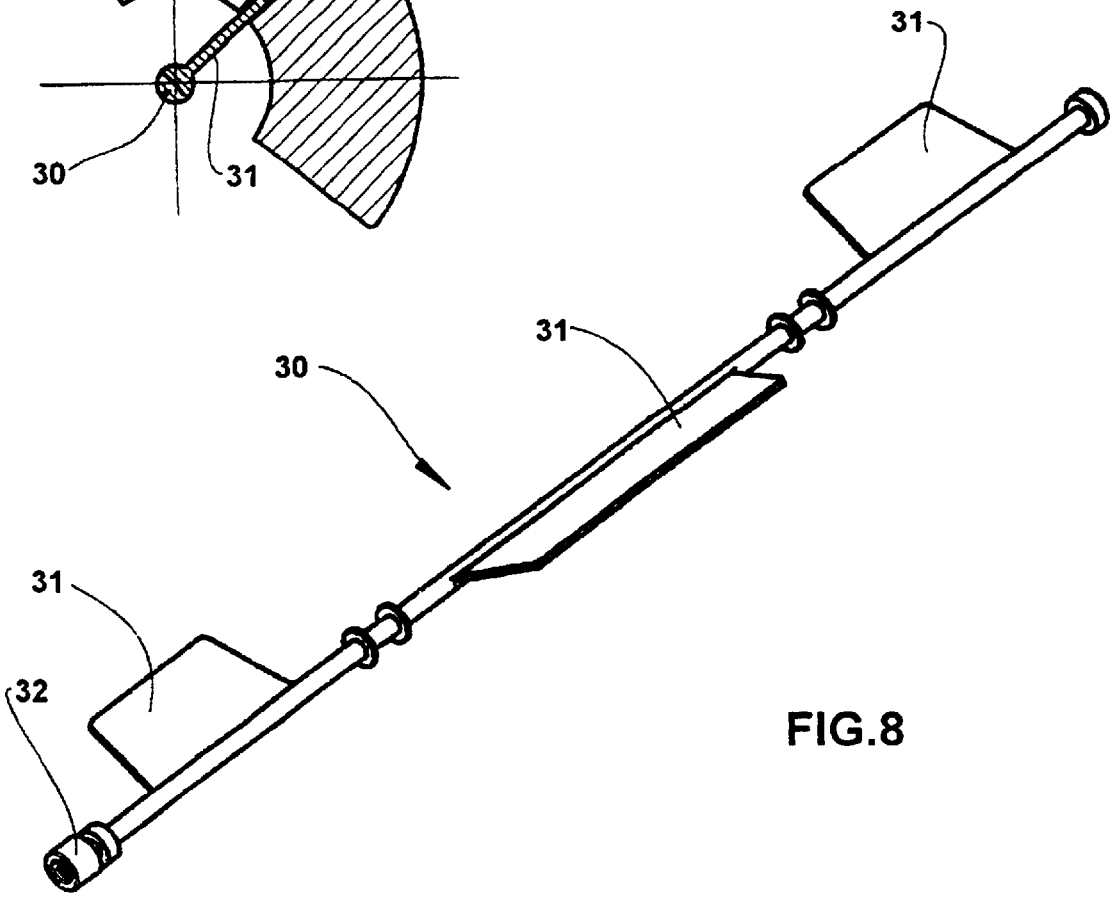
FIG. 8 illustrates, schematically and in a perspective view, the rotor shaft of the device of the present invention, without carrying the obturators.

In the construction illustrated in FIG. 8, the shaft 30 is in the form of a rod 31 provided with a plurality of radial flaps 31, each having a radial extension substantially matching with the inner radius of the respective hollow body 11, said radial flaps 31 being angularly and axially offset from each other, so that each may receive and affix a respective obturator 20, so that, upon rotation of the shaft 30, each operational position of an obturator 20 corresponds to at least one operational position of at least another obturator 20, i.e., so that the opening position of an obturator 20 corresponds to one of the opening and closing positions of at least another obturator 20.

In this construction, at an end of the rod 31 there is provided any mechanical coupling means 32 to engage the motor unit.

Figure 6:
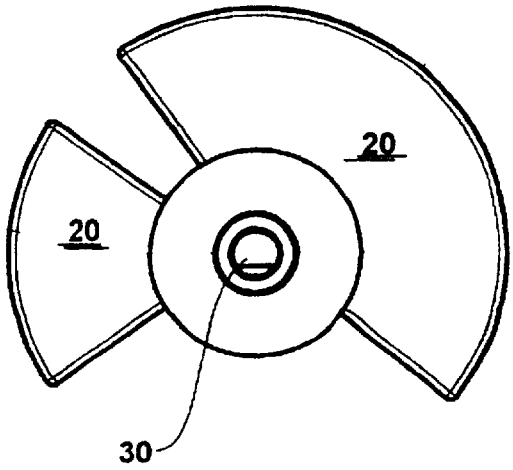
FIG. 6 illustrates, schematically and in a lateral view, the device of the present invention carrying obturators.
Figure 7:
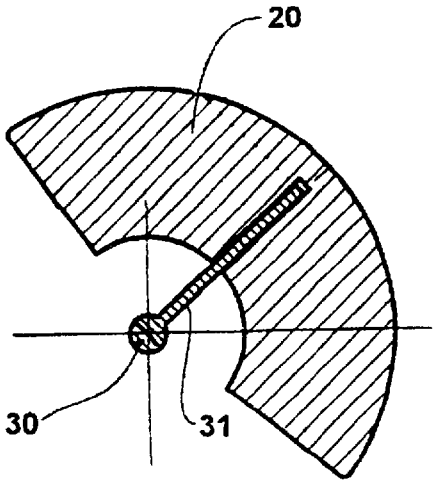
FIG. 7 illustrates, schematically and in a cross-sectional view, one of the obturators of the device of the present invention.

According to the illustrations of FIGS. 6 and 7, the controlling device of the present invention includes three obturators 20, each presenting a certain longitudinal extension corresponding to the longitudinal extension of the hollow body 11 to which it is mounted and a certain circumferential extension defined as a function of the actuation of said obturator 20 in the respective hollow body 11. In the illustrated construction, the obturator 20 acting with the inlet and outlet nozzles 12, 13 of the hollow body 11 corresponding to the defrost circuit has a circumferential extension superior to that of the other obturators 20, for example being of 180° and 90°, respectively, said obturators being offset from each other in about 90°.

According to the figures, each obturator 20 is in the form of a cylindrical sector having a determined circumferential extension and provided, from its inner wall, with a slot 21 having a certain radial extension towards the inside of the obturator 20 and a certain longitudinal extension, both extensions defined so as to fit a corresponding radial flap 31 of the shaft 30. According to the illustrations, the hollow bodies 11 are longitudinally aligned to each other, in such a way that each two adjacent hollow bodies 11 are separated by a transversal wall 14 of the tubular case 10 common to both. In the illustrated construction, the tubular case 10 is formed by two semi-cylindrical tubular portions, attachable to each other and around the shaft 30 and the obturators 20, said semi-cylindrical tubular portions having inner walls transversal to the longitudinal shaft of the tubular case 10, each two inner walls, which are aligned and coplanar upon assembly of the two semi-cylindrical tubular portions, defining a transversal wall 14 of the tubular case 10.

According to the illustrations, each hollow body 11 has its inlet and outlet nozzles 12, 13 angularly offset from each other and arranged so that the inlet and outlet nozzles 12, 13 of the hollow body 11 associated with the air flow heating chamber 4 of the defrost circuit are angularly offset in relation to the inlet and outlet nozzles 12, 13 of the other hollow bodies 11, for example in about 90°.

According to the present invention, each obturator 20 has a longitudinal extension substantially corresponding to that of the respective hollow body 11 and a radial extension determined in order to be sufficient to allow that, in a closing position, said obturator 20 blocks at least one of the inlet and outlet nozzles 12, 13 of the respective hollow body 11.

With the present invention, when the defrost operation condition for the refrigerator has been commanded, the rotation of the shaft 30 allows, simultaneously with the blocking of the fluid communication between the freezing and refrigerating compartments 1, 2 (if both exist in the refrigerator) and the evaporator 3, the fluid communication between the latter and the air flow heating chamber 4 of the defrost circuit and, during the refrigeration condition, it simultaneously blocks said fluid communication between the defrost circuit and the evaporator 3, while permitting the fluid communication between at least one of the freezing and refrigerating compartments 1, 2 with the evaporator 3.

According to the present invention, the opening and closing positions of the obturator 20 of the hollow body 11 in selective fluid communication with the defrost circuit corresponds, respectively, to the closing and opening positions of all the other obturators 20.

In the construction in which the refrigerator has freezing and refrigerating compartments 1, 2, but not a defrost circuit, the opening position of the obturator 20 of one of said compartments corresponds to one of the opening and closing positions of the obturator 20 corresponding to the other compartment.

For the illustrated construction, in which the refrigerator has the freezing compartment 1, the refrigerating compartment 2 and the defrost circuit, the controlling device of the present invention has three hollow bodies 11, each corresponding to one of said air flow heating environments, and permits the selective fluid communication between each environment and the evaporator 3 and also a simultaneous fluid communication of the freezing and refrigerating compartments 1, 2 with the evaporator 3, when both compartments require refrigeration.

In the independent or combined refrigeration conditions of the freezing and refrigerating compartments 1, 2, the obturator 20 corresponding to the defrost circuit will maintain a fluid communication blocking condition between the air flow heating chamber 4 of the defrost circuit and the evaporator 3, closing at least one of the inlet and outlet nozzles 12, 13 of the corresponding hollow body 11.

While only one constructive form has been described and illustrated for the present invention, other solutions are possible within the inventive concept presented herein, such as that providing a controlling device comprising, for each air flow heating environment, an inlet nozzle in fluid communication with the respective air flow heating environment and an outlet nozzle in fluid communication with the evaporator and each obturator being operatively associated with the respective inlet and outlet nozzles and affixed to a respective shaft portion.

With the present solution, it is possible, in a simple and practical way, to modify the conditions of refrigeration and activation of the automatic defrost, by driving only one shaft, as well as to allow an independent refrigeration to occur in each refrigeration environment of the refrigerator, as a function of the operational requirements.

What is claimed is:

1. An air flow controlling device for refrigerators and freezers, comprising at least two air flow heating environments (1, 2, 4) and an evaporator (3) positioned externally to said air flow heating environments (1, 2, 4) and in selective fluid communication therewith, characterized in that it comprises, for each air flow heating environment (1, 2, 4), a respective inlet nozzle (12) in fluid communication with the respective air flow heating environment (1, 2, 4), and a respective outlet nozzle (13) in fluid communication with the evaporator (3) and a respective obturator (20), which is operatively associated with the inlet and outlet nozzles (12, 13) and affixed to a respective shaft portion rotating between opening and closing positions, respectively permitting and blocking the fluid communication between said inlet and outlet nozzles (12, 13), said shaft portions of the obturators (20) forming a single common shaft (30), which is rotatively driven by a motor unit commanded by a control unit.

2. Device, as in claim 1, characterized in that each operational position of an obturator (20) corresponds to at least one operational position of at least another obturator (20).

3. Device, as in claim 2, wherein one of the air flow heating environments (4) defines an air heating chamber of a defrost circuit adjacent to the condenser of the refrigerator, one of the other air flow heating environments (1, 2) being defined by one of the freezing and refrigerating compartments, characterize d in that the opening and closing positions of the obturator (20) corresponding to said defrost circuit corresponds, respectively, to the closing and opening positions of any other obturator (20).

4. Device, as in claim 3, wherein the air flow heating environments (1, 2) are defined by at least one of the freezing and refrigerating compartments, characterized in that the opening position of the obturator (20) of one of said freezing and refrigerating compartments corresponds to one of the opening and closing positions of the obturator (20) corresponding to the other of said freezing and refrigerating compartments.

5. Device, as in claim 4, characterized in that the shaft (30) is in the form of a rod provided with a plurality of radial flaps (31), substantially matching with the inner radius of the respective hollow body (11) and which are angularly and axially offset from each other, so that each may receive and affix a respective obturator (20).

6. Device, as in claim 5, characterized in that each obturator (20) is in the form of a cylindrical sector having a determined circumferential extension.

7. Device, as in claim 5, characterized in that the inlet and outlet nozzles (12, 13) of the hollow body (11) corresponding to the defrost circuit are angularly offset in relation to the inlet and outlet nozzles (12, 13) of the other hollow bodies (11).

8. Device, as in claim 7, characterized in that the obturator (20) of each of the hollow bodies (11) corresponding to the freezing and refrigerating compartments (1, 2) are provided axially aligned to each other and angularly offset in relation to the obturator (20) of the hollow body (11) corresponding to the defrost circuit.

9. Device, as in claim 8, characterized in that said obturator (20) corresponding to the defrost circuit is circumferentially offset from the other obturators (20) in about 90°.

10. Device, as in claim 9, characterized in that the tubular case (10) is formed by two semi-cylindrical tubular portions, to be affixed to each other and around to the shaft (30) and the obturators (20) mounted thereon.

11. Device, as in claim 1, characterized in that it comprises, for each air flow heating environment (1, 2, 4), a hollow body (11) defining, internally, a chamber, in which are provided respective inlet and outlet nozzles (12, 13) and inside which is mounted a respective obturator (20).

12. Device, as in claim 11, characterized in that the hollow bodies (11) define a tubular case (10).

13. Device, as in claim 12, characterized in that the hollow bodies (11) are provided longitudinally adjacent to each other, each two adjacent hollow bodies (11) being separated by a common transversal wall (14).

14. Device, as in claim 11, characterize in that each obturator (20) has a longitudinal extension substantially corresponding to that of the respective hollow body (11) and a radial extension which is determined in order to be sufficient to block, in a closing position, at least one of the inlet and outlet nozzles (12, 13) of the respective hollow body (11).

* * * * *

UNITED STATES PATENT AND TRADEMARK OFFICE

CERTIFICATE OF CORRECTION

PATENT NO. : 6,584,790 B1
DATED : July 1, 2003
INVENTOR(S) : Luiz A. Lopes

It is certified that error appears in the above-identified patent and that said Letters Patent is hereby corrected as shown below:

Title page,
Item [22], PCT Filed:, delete "July 12, 2000" and substitute -- July 13, 2000 --

Signed and Sealed this

Eighteenth Day of November, 2003

JAMES E. ROGAN
*Director of the United States Patent and Trademark Office*